United States Patent [19]

Schaeffler

[11] Patent Number: 4,951,619

[45] Date of Patent: Aug. 28, 1990

[54] SELF-ADJUSTING HYDRAULIC VALVE TAPPET

[75] Inventor: Georg Schaeffler, Herzogenaurach, Fed. Rep. of Germany

[73] Assignee: INA Walzlager Schaeffler KG, Fed. Rep. of Germany

[21] Appl. No.: 472,722

[22] Filed: Jan. 31, 1990

[30] Foreign Application Priority Data

Mar. 8, 1989 [DE] Fed. Rep. of Germany ... 8902780[U]

[51] Int. Cl.[5] ..... F01L 1/24

[52] U.S. Cl. ..... 123/90.55

[58] Field of Search ..... 123/90.48, 90.52, 90.53, 123/90.55

[56] References Cited

U.S. PATENT DOCUMENTS

| | | | |
|---|---|---|---|
| 4,465,038 | 8/1984 | Speil | 123/90.55 |
| 4,590,898 | 5/1986 | Buente et al. | 123/90.55 |
| 4,635,593 | 1/1987 | Kodama | 123/90.55 |
| 4,648,360 | 3/1987 | Schaeffler | 123/90.55 |
| 4,688,525 | 8/1987 | Nakamura | 123/90.55 |
| 4,721,076 | 1/1988 | Goppelt et al. | 123/90.55 |
| 4,779,583 | 10/1988 | Laffter et al. | 123/90.55 |
| 4,825,823 | 5/1989 | Schaeffler | 123/90.55 |
| 4,876,997 | 10/1989 | Zorn et al. | 123/90.55 |

FOREIGN PATENT DOCUMENTS 3437478 4/1986 Fed. Rep. of Germany ... 123/90.55

*Primary Examiner*—David A. Okonsky
*Assistant Examiner*—Weilun Lo
*Attorney, Agent, or Firm*—Bierman and Muserlian

[57] ABSTRACT

A self-adjusting hydraulic valve tappet arranged in a guide bore of a cylinder head of an internal combustion engine and against one end face of which a control cam abuts and which on the other side bears against the end of a valve stem with its second end face, the valve tappet comprising a cup-shaped housing consisting of a hollow cylindrical wall closed at one end by a bottom against which the control cam abuts from outside and which is provided with a cylindrical guide sleeve concentric with the hollow cylindrical wall and extending at one end towards the bottom and at the other into the center of a disk member which with its outer periphery merges into the hollow cylindrical wall of the housing whereby between the hollow cylindrical wall and the cylindrical guide sleeve an annular oil reservoir supplied with oil through a bore leading to the out-side is defined, the actual hydraulic clearance compensation element being guided longitudinally displaceably in the guide sleeve and formed by an inner piston and an outer piston engaging over this.

9 Claims, 2 Drawing Sheets

SELF-ADJUSTING HYDRAULIC VALVE TAPPET

STATE OF THE ART

Figure 1:
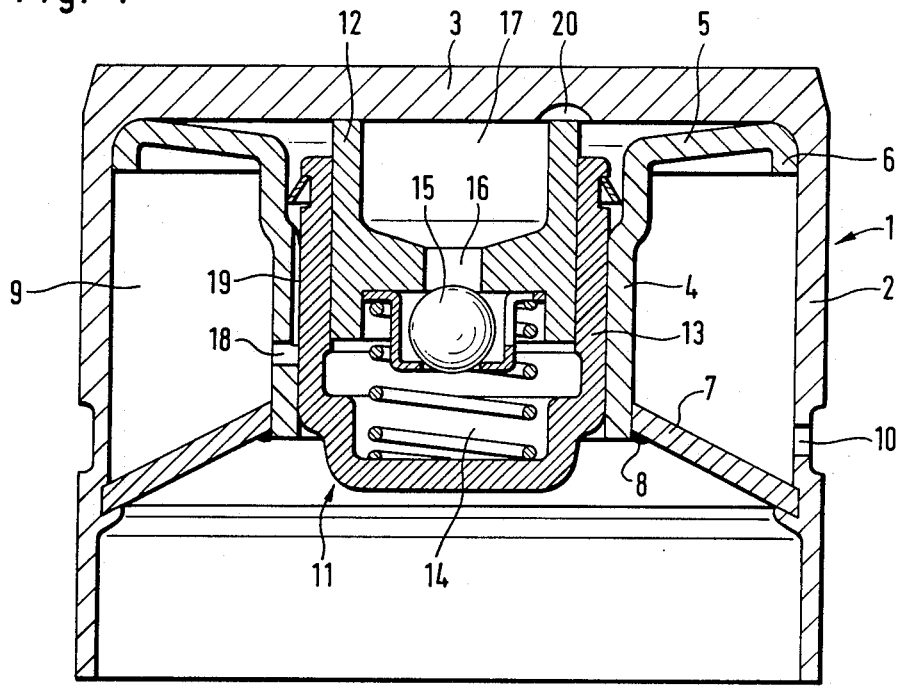

Self-adjusting hydraulic valve tappets arranged in a guide bore of a cylinder head of an internal combustion engine and against one end face of which a control cam abuts and which on the other side bears against the end of a valve stem and its second end face, the valve tappet comprising a cup-shaped housing consisting of a hollow cylindrical wall closed at one end by a bottom against which the control cam abuts from outside and which is provided with a cylindrical guide sleeve concentric with the hollow cylindrical wall and extending at one end towards the bottom and at the other into the center of a disk member which with its outer periphery merges into the hollow cylindrical wall of the housing whereby between the hollow cylindrical wall and the cylindrical guide sleeve an annular oil reservoir supplied with oil through a bore leading to the outside is defined, the actual hydraulic clearance compensation element being guided longitudinally displaceably in the guide sleeve and formed by an inner piston and an outer piston engaging over this, the two pistons being guided longitudinally displaceably in each other and together delimiting an oil pressure chamber which is connected through a bore in the inner piston closed by a non-return valve with a central oil reservoir arranged in the inner piston and delimited on one side by the wall of the inner piston and on the other by the inner surface of the bottom of the housing against which the inner piston bears with one end face whereas the outer piston is longitudinally displaceaby mounted in the cylindrical guide sleeve and bears with its closed end against the end of the valve stem, the guide sleeve being provided at a location at a distance from the bottom and preferably in the vicinity of its end away from the bottom, with an inlet port opening into a canal which extends towards the bottom and is delimited on the on hand by the outer peripheral surface of the outer piston and on the other by the bore of the guide sleeve, an oil passage opening into the central oil reservoir being provided at the end of the inner piston facing the bottom are known.

In a known construction of this type, as described in DE-OS 3,528,432, the guide sleeve at its end away from the disk member is joined directly to the bottom. Deflections of the bottom such as occur in operation at the abutting of the cam are thus communicated directly to the guide sleeve and the disk member. As a result of the high frequency of these deflections, there is the danger that fractures can occur at the guide sleeve and/or disk member or that the joint of the disk member to the bore of the hollow cylindrical outer wall, which is often made by welding, is disrupted.

OBJECTS OF THE INVENTION

It is an object of the invention to avoid the disacvantages of the known construction while retaining its advantages and particularly, to assure that eventual deflections of the bottom have no influence on the guide sleeve and the parts connected with it.

This and other objects and advantages of the invention will become obvious from the following detailed description.

THE INVENTION

The self-adjusting hydraulic valve tappet of the invention arranged in a guide bore of a cylinder head of an internal combustion engine and against one end face of which a control cam abuts and which on the other side bears against the end of a valve stem with its second end face, the valve tappet comprising a cup-shaped housing consisting of a hollow cylindrical wall closed at one end by the bottom against which the control cam abuts from outside and which is provided with a cylindrical guide sleeve concentric with the hollow cylindrical wall and extending at one end towards the bottom and at the other into the center of a disk member which with its outer periphery merges into the hollow cylindrical wall of the housing whereby between the hollow cylindrical wall and the cylindrical guide sleeve an annular oil reservoir supplied with oil through a bore leading to the outside is defined, the actual hydraulic clearance compensation element being guided longitudinally displaceably in the guide sleeve and formed by and inner piston and an outer piston engaging over this, the two pistons being guided longitudinally displaceably in each other and together delimiting an oil pressure chamber which is connected through a bore in the inner piston closed by a non-return valve with a central oil reservoir arranged in the inner piston and delimited on one side by the wall of the inner piston and on the other by the inner surface of the bottom of the housing against which the inner piston bears with one end face whereas the outer piston is longitudinally displaceably mounted in the cylindrical guide sleeve and bears with its closed end against the end of the valve stem, the guide sleeve being provided at a location at a distance from the bottom and preferably in the vicinity of its end away from the bottom, with an inlet port opening into a canal which extends towards the bottom and is delimited on the one hand by the outer peripheral surface of the outer piston and on the other by the bore of the guide sleeve, an oil passage opening into the central oil reservoir being provided at the end of the inner piston facing the bottom, is characterized in that the guide sleeve is provided at its end near the bottom with an almost radially outwards directed flange situated at a distance from the bottom and extending up to the bore of the hollow cylindrical wall. In this way the guide sleeve is clearly separated from the bottom so that deflections of the latter can no longer have a detrimental effect on the guide sleeve.

It is advantageous to make the guide sleeve and the flange in one piece and to join them in a liquid-proof manner to the separately manufactured disk member. It has proved to be advantageous to provide the flange at its radially outer edge with a short cylindrical collar turned axially away from the bottom and which bears in the bore of the hollow cylindrical wall. By this measure, if the cylindrical collar is pressed into the bore of the hollow cylindrical wall with a sufficient over-size, a liquid-proof joint can be obtained without the need of additional measures like e.g., welding.

The flange itself can be made slightly funnel-shaped so as to be in contact with the inner surface of the bottom only through its radially outermost region. Consequently, it then has contact with the bottom only at a location where deflections of the bottom no longer have an influence. The contact between flange and inner surface can, however, also be completely excluded by making the flange bear against a shoulder of the hollow cylindrical wall provided at a slight distance from the bottom.

It has also proved to be of advantage to provide the disk member at its center with a short collar directed axially towards the bottom which collar receives the end of the guide sleeve. If it proves to be additionally necessary, the disk member and the guide sleeve can also be joined to each other in a liquid-proof manner by welding, soldering, bonding or the like. It is also possible within the scope of the invention to join the guide sleeve and the disk member to each other with an annular part made of polymeric material which receives the free ends of the guide sleeve on one side and of the disk member on the other in peripheral grooves sealing them at the same time in a liquid-proof manner.

Finally, the invention offers another variant in which the disk member is formed so that at its radially outer edge, it merges into a hollow cylindrical sleeve which with its outer peripheral surface bears on the bore of the hollow cylincrical wall of the cup-shaped housing and at one end face bears against the outer edge of the flange and which, at a point of its periphery coinciding with the bore for the oil supply, is deformed into a longitudinal groove which together with the bore wall of the hollow cylindrical wall forms a longitudinal canal into whose lower region the bore for the oil supply opens and which at its end facing the bottom is open towards the annular oil reservoir.

Referring now to the drawings:

FIGS. 1 to 4 are four different embodiments of the invention in longitudinal cross-section.

The valve tappet of FIG. 1 comprises a cup-shaped housing 1 made up of the hollow cylindrical wall 2 which is closed at its upper end by the bottom 3. Within the hollow cylindrical wall 2 and concentrically with it, the guide sleeve 4 is arranged which at its end towards the bottom merges into the almost radially directed flange 5 made in one piece with it, which in turn, at its radially outer edge, has a short cylindrical collar 6 turned axially away from the bottom 3 with which collar it bears in the bore of the hollow cylindrical wall 2.

At its end opposed to the flange 5, the guide sleeve is fixed in the center of a disk member 7 by a weld joint 8. The disk member 7 in turn is joined in a liquid-proof manner to the hollow cylindrical wall 2 by the fact that on the one side it bears against a shoulder of the wall 2 and on the other is retained by a bead formed out of the wall by non-cutting shaping.

The hollow cylindrical wall 2, the disk member 7, the guide sleeve 4 and the flange 5 together define an annular oil reservoir 9 supplied with oil from the lubricating oil circuit of the internal combustion engine through a bore 10. Within the guide sleeve 4, the actual hydraulic clearance compensation element 11 is longitudinally displaceably guided and formed by the inner piston 12 and the outer piston 13 which engages over this, the two pistons being longitudinally displaceably guided in each other and together defining the oil pressure chamber 14. This is connected to the central oil reservoir 17 in the inner piston 12 through the bore 16 closed by the non-return valve 15.

In the vicinity of the disk member 7, an inlet port 18 is provided in the guide sleeve 4 which opens into the canal 19 which extends towards the bottom and is delimited on the one hand by the outer peripheral surface of the outer piston 13 and on the other by the bore of the guide sleeve 4. At the end of the inner piston 12 finally, an oil passage 20 is provided in the bottom 3.

By the fact that in this embodiment, the flange 5 has contact with the inner surface of the bottom 3 only with its radially outermost region, it is assured that deflections of the bottom 3 occuring in operation have no effect on the flange 5 and thereby on the guide sleeve 4 and the disk member 7. Thus, damage to these parts or the joints between them is excluded.

Figure 2:
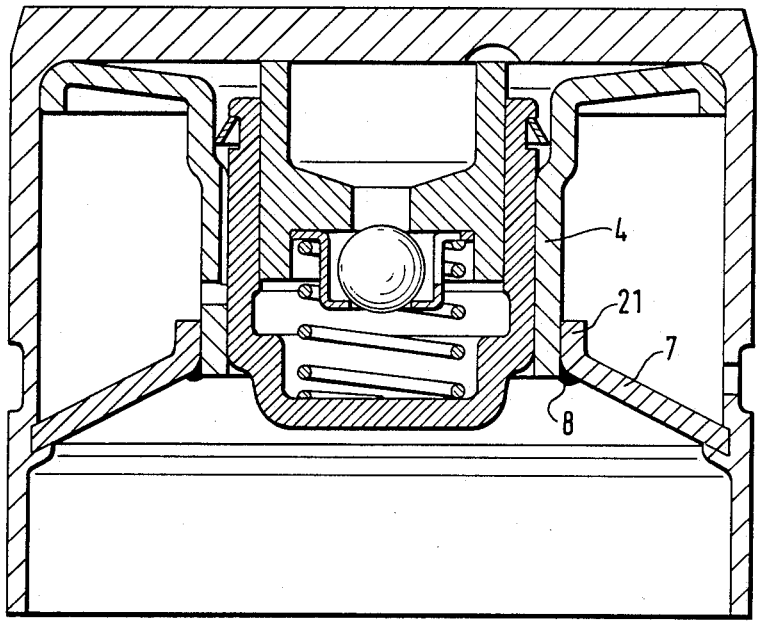

The embodiment of FIG. 2 differs from that of FIG. 1 only in that the disk member 7 has a short collar 21 at its center directed axially towards the bottom 3, which collar 21 receives the end of the guide sleeve 4 and a weld joint 8 is provided in this case as well for making a liquid-proof joint.

Figure 3:
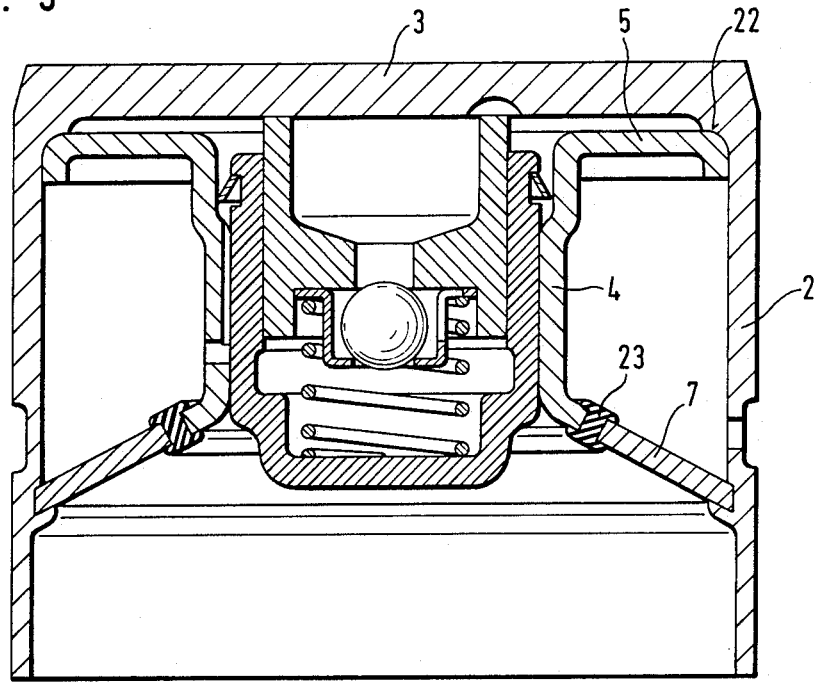

Contrary to FIG. 1, in the embodiment of FIG. 3, the flange 5 extends exclusively radially. To guarantee a safe distance from the inner surface of the bottom 3, the flange 5 bears in this case against a shoulder 22 of the hollow cylindrical wall 2. In this way, it is guaranteed with certainly that deflections of the bottom 3 cannot have any effect on the flange. The joint between the guide sleeve 4 on the one hand and the disk member 7 on the other is made in this embodiment by means of an annular element 23 of polymeric material which receives the free ends of the guide sleeve 4 on the one side and the disk member 7 on the other in peripheral grooves sealing them at the same time in a liquid-proof manner.

Figure 4:
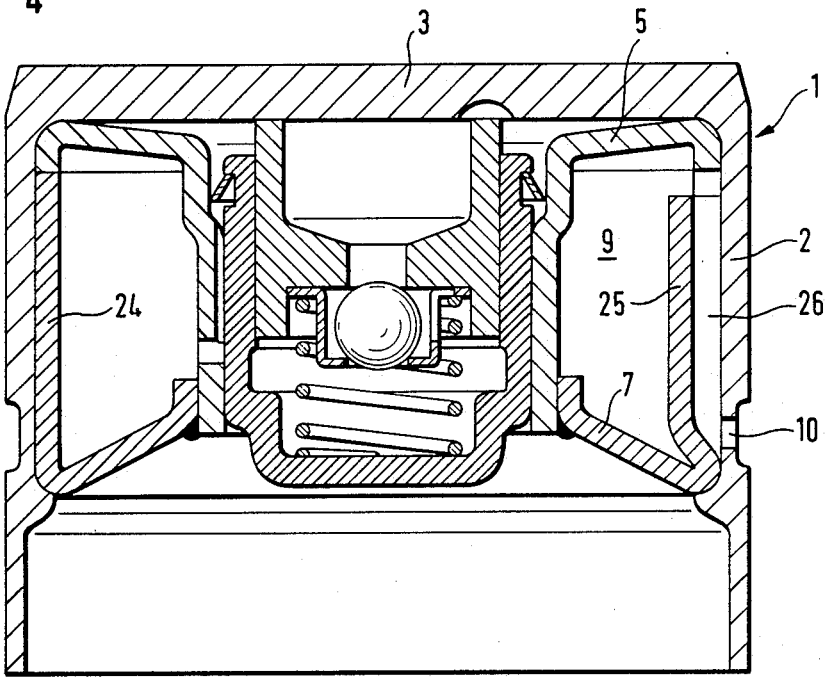

Finally, in FIG. 4 a variation of the embodiment of FIG. 2 is represented in which the disk member 7 at its radially outer edge merges into a hollow cylincrical sleeve 24 which with its outer peripherial surface bears in the bore of the hollow cylindrical wall 2 of the cup-shaped housing 1 and at one end face bears against the outer edge of the flange 5 and which at a point of its periphery coinciding with the bore 10 for the oil supply is deformed into a longitudinal groove 25 which together with the bore wall 2 forms a longitudinal canal 26 in whose lower region the bore 10 opens and which at its end facing the bottom 3 is open towards the annular oil reservoir 9. By this design it is achieved that during a standstill of the internal combustion engine the annular oil reservoir 9 cannot get emptied.

Various modifications of the tappet of the invention may be made without departing from the spirit or scope thereof and it should be understood that the invention is intended to be limited only as defined in the appended claims.

What I claim is:

1. A self-adjusting hydraulic valve tappet arranged in a guide bore of a cylinder head of an internal cumbustion engine and against one end face of which a control cam abuts and which on the other side bears against the end of a valve stem with its second end face, the valve tappet comprising a cup-shaped housing consisting of a hollow cylindrical wall closed at one end by a bottom against which the control cam abuts from outside and which is provided with a cylindrical guide sleeve concentric with the hollow cylindrical wall and extending at one end towards the bottom and at the other into the center of a disk member which with its outer periphery merges into the hollow cylindrical wall of the housing wherein between the hollow cylindrical wall and the cylindrical guide sleeve an annular oil reservoir supplied with oil through a bore leading to the outside is defined, the actual hydraulic clearance compensation element being guided longitudinally displaceably in the guide sleeve and formed by an inner piston and an outer piston engaging over this, the inner piston being guided longitudinally displaceably within the outer piston and together delimiting an oil pressure chamber which is connected through a bore in the inner piston closed by a non-return valve with a central oil reservoir arranged in the inner piston and delimited on one side by the ball of the inner piston and on the other by the inner surface of the bottom of the housing against which the inner piston bears with one end face whereas the outer piston is longitudinally displaceably mounted in the cylindrical guide sleeve and bears with its closed end against the end of the valve stem, the guide sleeve being provided at a location at a distance from the bottom and preferably in the vicinity of its end away from the bottom, with an inlet port opening into a canal which extends towards the bottom and is delimited on the one hand by the outer peripheral surface of the outer piston and on the other by the bore of the guide sleeve, an oil passage opening into the central oil reservoir being provided at the end of the inner piston facing the bottom, characterized in that the guide sleeve is provided at its end near the bottom with an almost radially outwards directed flange situated at a distance from the bottom and extending up to the bore of the hollow cylindrical wall, and the guide sleeve being radially inward of the disc member and in direct contact with the outer piston.

2. A valve tappet of claim 1 wherein the guide sleeve and the flange are made in one piece and joined in a liquid-proof manner to the disk member.

3. A valve tappet of claim 1 wherein the flange merges at its radially outer edge into a short cylindrical collar turned axially away from the bottom and which bears in the bore of the hollow cylindrical wall.

4. A valve tappet of claim 1 wherein the flange is made slightly funnel-shaped so as to be in contact with the inner surface of the bottom only through its radially outermost region.

5. A valve tappet of claim 1 wherein the flange bears against a shoulder of the hollow cylindrical wall so that it has no contact with the inner surface of the bottom.

6. A valve tappet of claim 2 wherein the disk member at its center has a short collar directed axially towards the bottom which collar receives the end of the guide sleeve.

7. A valve tappet of claim 6 wherein the disk member and the guide sleeve are joined to each other in a liquid-proof manner by welding, soldering, bonding or the like.

8. A valve tappet of claim 2 wherein the guide sleeve and the disk member are joined to each other by an annular part made of polymeric material which receives the free ends of the guide sleeve on one side and of the disk member on the other in peripheral grooves sealing them at the same time in a liquid-proof manner.

9. A valve tappet of claim 1 wherein the disk member at its radially outer edge merges into a hollow cylindrical sleeve which with its outer peripheral surface bears in the bore of the hollow cylindrical wall of the cup-shaped housing and at one end face bears against the outer edge of the flange and which , at a point of its periphery coinciding with the bore for the oil supply, is deformed into a longitudinal groove which together with the bore wall of the hollow cylindrical wall forms a longitudinal canal into whose lower region the bore for the oil supply opens and which at its end facing the bottom is open towards the annular oil reservoir.

* * * * *